United States Patent [19]

Pinnow et al.

[11] 4,119,765

[45] * Oct. 10, 1978

[54] WELDED FERRITIC STAINLESS STEEL ARTICLES

[75] Inventors: Kenneth E. Pinnow; Jerome P. Bressanelli, both of Pittsburgh, Pa.

[73] Assignee: Crucible Inc., Pittsburgh, Pa.

[ * ] Notice: The portion of the term of this patent subsequent to May 18, 1993, has been disclaimed.

[21] Appl. No.: 821,896

[22] Filed: Aug. 4, 1977

Related U.S. Application Data

[63] Continuation-in-part of Ser. No. 680,547, Apr. 27, 1976, abandoned.

[51] Int. Cl.[2] ..... B32B 15/18

[52] U.S. Cl. ..... 428/683; 75/128 N; 75/128 G; 75/128 T; 75/128 W; 148/37

[58] Field of Search ..... 428/683; 148/37; 75/128 G, 128 T, 128 W, 128 N

[56] References Cited

U.S. PATENT DOCUMENTS

| | | | |
|---|---|---|---|
| 3,807,991 | 4/1974 | Gregory et al. | 75/126 F |
| 3,837,847 | 9/1974 | Bieber | 75/128 W |
| 3,929,473 | 12/1975 | Streicher | 75/128 W |
| 3,957,544 | 5/1976 | Pinnow et al. | 75/128 W |
| 4,059,440 | 11/1977 | Takemura et al. | 148/37 |

*Primary Examiner*—Arthur J. Steiner

[57] ABSTRACT

A stainless steel welded article with excellent corrosion resistance, formability and notch toughness, such as welded tubing and the like, made from a columbium and/or titanium stabilized substantially fully ferritic stainless steel consisting essentially of, in weight percent, below 0.04 carbon, below 0.04 nitrogen, the sum of the carbon and nitrogen contents being above 0.006 and below 0.07, up to 1.0 manganese, up to 1.0 silicon, 23.0 to less than 28.0 chromium, 2.00 to 4.75 nickel, 0.75 to 3.50 molybdenum, and the balance iron and incidental impurities. When carbon plus nitrogen is in the range of 0.006 to 0.04, columbium in the amount of 0.05 to 0.70 may be used alone, but the columbium content must be at lest equal to eight times the carbon plus nitrogen content. When carbon plus nitrogen is in the range of 0.02 to 0.07, titanium in the amount of 0.12 to 0.70 may be used alone, providing titanium is present in an amount at least equal to six times the carbon plus nitrogen content, or it may be used in combination with columbium with each being present in an amount up to 0.30 providing the titanium and columbium contents are at least equal to those satisfying the following equation:

$$\% Ti/6 + \% Cb/8 = (\% C + \% N)$$

When the molybdenum content is within the range of 2.50 or 3.00 to 3.50% nickel may be lowered to 1%.

33 Claims, No Drawings

WELDED FERRITIC STAINLESS STEEL ARTICLES

This application is a continuation-in-part of copending application Ser. No. 680,547, filed Apr. 27, 1976, now abandoned.

Stainless steels are extensively used in the chemical, petrochemical and energy fields; and their use in these areas is increasing. Furthermore, in the future considerable quantities of stainless steel will be used in nuclear energy installations, refinery equipment, pollution control systems and in coal gasification and liquefaction plants. Since numerous heat exchange systems are employed in these applications, stainless steel pipe or tubing will be required in unprecedented quantities. Most often, the pipe or tubing selected for these applications is produced by continuous autogenous welding of roll-formed strip. Further, even in those cases where seamless (nonwelded) tubing is used, welding is often employed in the installation of the tubes in the system, as for example in joining of heat exchanger tubes to the tube sheet. The weldability of the stainless steels used for pipe, tubing and other weldments is therefore a critically important property.

Stainless steel weldments selected for use in chemical, petrochemical and similar service must combine good resistance to general, pitting, crevice and stress-corrosion along with a variety of mechanical properties such as good fabricability, strength, ductility and toughness. For example, to avoid brittle failures during impact loading in fabrication or in service, the Charpy V-notch transition temperature of such weldments must be below ambient, e.g. 32° F. (0° C.). These properties are important whether an application involves welding or not, but with most stainless steels special measures must be taken to assure that these properties will be maintained in the welded condition. Stainless steel weldments, for example, are generally more susceptible to intergranular or stress corrosion than are other product forms and therefore the composition of stainless steels which are to be welded must be much more closely controlled than those which are not welded. Also, stainless steel welds frequently exhibit much less ductility and notch toughness than the unwelded base material, and for this reason special consideration must again be given to the composition of stainless steels earmarked for welding. Further, for a stainless steel to be considered for welding applications, it must be capable of being joined in the welding process with a minimum of difficulty, and after welding the weldment must be free of defects such as voids or cracks.

In spite of their higher cost, the austenitic stainless steels have been preferred over the ferritic stainless steels for applications involving welding, largely because of their superior toughness, ductility, formability and corrosion resistance in the as-welded condition. Many of the conventional high chromium ferritic stainless steels, such as AISI Types 442 and 446, have good mechanical properties and corrosion resistance in the annealed condition, but are considered in the trade as being "nonweldable" for one or more of the reasons discussed above. Type 446, for example, is highly susceptible to embrittlement and intergranular corrosion after welding; if it is used in the welded condition at all, it must be annealed after welding to restore corrosion resistance and to improve mechanical properties. Further, the corrosion resistance of Type 446 stainless welds, even in the annealed condition, is inadequate for use in marine environments due to extensive pitting or crevice attack and in many chemical environments due to excessive general attack in strong reducing acid media. We have found, however, that with the high-chromium ferritic stainless steels within the composition limits of our invention, as described hereinafter, it is possible to produce ferritic stainless steel weldments with exceptionally good corrosion resistance and mechanical properties in the as-welded condition.

It is well known by those skilled in the art that lowering the carbon and nitrogen contents of the high-chromium ferritic stainless steels, such as Types 442 and 446, substantially improves their notch toughness and resistance to embrittlement and intergranular corrosion after welding or heat treatment. For example, U.S. Pat. No. 2,624,671 shows that alloys with chromium contents from 25 to 30% are relatively tough if the total carbon plus nitrogen content is below about 0.025%. However, we have found that still lower carbon and nitrogen contents on the order of 0.003% each of carbon and nitrogen are needed to eliminate their susceptibility to intergranular attack after welding. Production of the high-chromium ferritic stainless steels at these levels of carbon and nitrogen is extremely difficult, and the required processes are currently impractical or very expensive.

Titanium or columbium stabilization is another well known method for reducing the susceptibility of the high-chromium ferritic stainless steels to intergranular attack. Moreover, stabilization is more practical and economical than lowering carbon and nitrogen contents, because it is effective at the carbon and nitrogen levels attainable by conventional melting and refining methods. However, we have discovered that titanium and/or columbium stabilization of the high-chromium ferritic stainless steels can cause cracking during welding or seriously reduce weld formability unless the composition of these steels, in particular carbon and nitrogen content, is controlled within certain critical limits.

Molybdenum substantially improves the resistance of the high-chromium ferritic stainless steels to pitting and crevice corrosion and is commonly added to these steels for these purposes. Molybdenum is also very useful in the weldments of this invention, but we have found that when it is present above a critical amount it combines with chromium, titanium, columbium, silicon and iron during welding or processing to form undesirable second phases, such as alpha-prime or sigma, which phases substantially reduce notch toughness. Due to the presence of titanium and columbium, the critical amount of molybdenum producing alpha-prime or sigma phase in the stabilized weldments of this invention is smaller than in nonstabilized ferritic stainless weldments with similar chromium and silicon contents. High molybdenum contents, within the range of the applicants' invention, are beneficial, in combination with nickel, to corrosion resistance in strong reducing acid media.

Nickel is a strong austenite former, but as shown in U.S. Pat. Nos. 3,837,847 and 3,929,473 it can be used to improve the notch toughness or acid resistance of the high chromium ferritic stainless steels. However, we have found that when nickel is added to improve the properties of molybdenum-bearing titanium or columbium stabilized ferritic stainless welds the nickel and molybdenum contents must be closely regulated so as to improve notch toughness and acid resistance without reducing stress corrosion resistance and other properties. Further, excessive amounts of nickel introduce austenite which has a detrimental effect on pitting resistance.

It is therefore the primary object of this invention to provide a substantially fully ferritic stainless steel weldment, characterized by high resistance to cracking during welding, and having high resistance to intergranular, general, pitting and crevice corrosion in saline, chemical and other environments, and good toughness and formability in the as-welded condition.

A further more specific object of this invention is to provide a substantially fully ferritic stainless steel weldment with the properties described above, but which is also highly resistant to stress corrosion cracking.

Another object of this invention is to provide a substantially fully ferritic stainless steel weldment which has good resistance to reducing acid media.

A still further object of this invention is to provide a substantially fully ferritic stainless steel weldment which has especially good resistance to reducing inorganic acids and good notch toughness at temperatures at or below 32° F. (0° C.).

Another more specific object of the invention is to provide a substantially fully stainless steel weldment which has especially good resistance to pitting and crevice corrosion in seawater and other harsh environments at slightly elevated temperatures, e.g. 104° F. (40° C.).

These and other objects of the invention as well as a complete understanding thereof may be obtained from the following description and specific examples.

To achieve the specific combinations of weld cracking resistance, corrosion resistance, formability, notch toughness and other recited properties with the welded articles of this invention it is essential that their composition be controlled within the limits given in TABLES I and IA.

TABLE I

BROAD, PREFERRED AND NARROW COMPOSITION RANGES OF STAINLESS WELDMENTS (Percent by Weight)

| Element | Broad Range | Preferred Ranges | | Narrow Ranges | |
|---|---|---|---|---|---|
| **Columbian-Stabilized Weldments** | | | | | |
| C | 0.003 to 0.04 | 0.003 to 0.04 | 0.003 to 0.04 | 0.003 to 0.04 | 0.003 to 0.04 |
| N | 0.003 to 0.04 | 0.003 to 0.04 | 0.003 to 0.04 | 0.003 to 0.04 | 0.003 to 0.04 |
| C+N | 0.006 to <0.04 | 0.006 to <0.04 | 0.006 to <0.04 | 0.006 to <0.04 | 0.006 to <0.04 |
| Mn | 1.00 max. | 1.00 max. | 1.00 max. | 1.00 max. | 1.00 max. |
| Si | 1.00 max. | 1.00 max. | 1.00 max. | 1.00 max. | 1.00 max. |
| Ni | 2.00 to 4.75 | 3.00 to 4.75 | 2.00 to 4.75 | 3.00 to 4.75 | 3.00 to 4.75 |
| Cr | 23.00 to <28.00 | 23.00 to <28.00 | 23.00 to <28.00 | 23.00 to <28.00 | 23.00 to <28.00 |
| Mo | 0.75 to 3.50 | 0.75 to 3.50 | 0.75 to 2.75 | 0.75 to 2.75 | 2.00 to 3.50 |
| Cb | 0.05 to 0.70 | 0.05 to 0.70 | 0.05 to 0.70 | 0.05 to 0.70 | 0.05 to 0.70 |
| | 8(C+N) min. | 8(C+N) min. | 8(C+N) min. | 8(C+N) min. | 8(C+N) min. |
| **Titanium-Stabilized Weldments** | | | | | |
| C | 0.04 max. | 0.04 max. | 0.04 max. | 0.04 max. | 0.04 max. |
| N | 0.04 max. | 0.04 max. | 0.04 max. | 0.04 max. | 0.04 max. |
| C+N | >0.02 to <0.07 | >0.02 to <0.07 | >0.02 to <0.07 | >0.02 to <0.07 | >0.02 to <0.07 |
| Mn | 1.00 max. | 1.00 max. | 1.00 max. | 1.00 max. | 1.00 max. |
| Si | 1.00 max. | 1.00 max. | 1.00 max. | 1.00 max. | 1.00 max. |
| Ni | 2.00 to 4.75 | 2.00 to 4.75 | 3.00 to 4.75 | 3.00 to 4.75 | 3.00 to 4.75 |
| Cr | 23.00 to <28.00 | 23.00 to <28.00 | 23.00 to <28.00 | 23.00 to <28.00 | 23.00 to <28.00 |
| Mo | 0.75 to 3.50 | 0.75 to 2.75 | 0.75 to 3.50 | 0.75 to 2.75 | 2.00 to 3.50 |
| Ti | 0.12 to 0.70 | 0.12 to 0.70 | 0.12 to 0.70 | 0.12 to 0.70 | 0.12 to 0.70 |
| | 6(C+N) min. | 6(C+N) min. | 6(C+N) min. | 6(C+N) min. | 6(C+N) min. |
| **Titanium and Columbium Stabilized Weldments** | | | | | |
| C | 0.04 max. | 0.04 max. | 0.04 max. | 0.04 max. | 0.04 max. |
| N | 0.04 max. | 0.04 max. | 0.04 max. | 0.04 max. | 0.04 max. |
| C+N | >0.02 to <0.07 | >0.02 to <0.07 | >0.02 to <0.07 | >0.02 to <0.07 | >0.02 to <0.07 |
| Mn | 1.00 max. | 1.00 max. | 1.00 max. | 1.00 max. | 1.00 max. |
| Si | 1.00 max. | 1.00 max. | 1.00 max. | 1.00 max. | 1.00 max. |
| Ni | 2.00 to 4.75 | 2.00 to 4.75 | 3.00 to 4.75 | 3.00 to 4.75 | 3.00 to 4.75 |
| Cr | 23.00 to <28.00 | 23.00 to <28.00 | 23.00 to <28.00 | 23.00 to <28.00 | 23.00 to <28.00 |
| Mo | 0.75 to 3.50 | 0.75 to 2.75 | 0.75 to 3.50 | 0.75 to 2.75 | 2.00 to 3.50 |
| Ti | 0.30 max. | 0.30 max. | 0.30 max. | 0.30 max. | 0.30 max. |
| Cb | 0.30 max. | 0.30 max. | 0.30 max. | 0.30 max. | 0.30 max. |
| Ti + Cb | At least equal to: $\frac{Ti}{6} + \frac{Cb}{8} = (C + N)$ | At least equal to: $\frac{Ti}{6} + \frac{Cb}{8} = (C + N)$ | At least equal to: $\frac{Ti}{6} + \frac{Cb}{8} = (C + N)$ | At least equal to: $\frac{Ti}{6} + \frac{Cb}{8} = (C + N)$ | At least equal to: $\frac{Ti}{6} + \frac{Cb}{8} = (C + N)$ |

TABLE IA (Percent by Weight)

| Element | Columbium-Stabilized Weldments | | Titanium-Stabilized Weldments | | Titanium & Columbium Stabilized Weldments | |
|---|---|---|---|---|---|---|
| C | 0.003 to 0.04 | 0.003 to 0.04 | 0.04 max. | 0.04 max. | 0.04 max. | 0.04 max. |
| N | 0.003 to 0.04 | 0.003 to 0.04 | 0.04 max. | 0.04 max. | 0.04 max. | 0.04 max. |
| C+N | 0.006 to <0.04 | 0.006 to <0.04 | >0.02 to <0.07 | >0.02 to <0.07 | >0.02 to <0.07 | >0.02 to <0.07 |
| Mn | 1.00 max. | 1.00 max. | 1.00 max. | 1.00 max. | 1.00 max. | 1.00 max. |
| Si | 1.00 max. | 1.00 max. | 1.00 max. | 1.00 max. | 1.00 max. | 1.00 max. |
| Ni | 1.00 to 4.75 | 1.00 to 4.75 | 1.00 to 4.75 | 1.00 to 4.75 | 1.00 to 4.75 | 1.00 to 4.75 |
| Cr | 23.00 to <28.00 | 23.00 to <28.00 | 23.00 to <28.00 | 23.00 to <28.00 | 23.00 to <28.00 | 23.00 to <28.00 |
| Mo | 2.50 to 3.50 | 3.00 to 3.50 | 2.50 to 3.50 | 3.00 to 3.50 | 2.50 to 3.50 | 3.00 to 3.50 |
| Cb | 0.05 to 0.70 | 0.05 to 0.70 | | | 0.30 max. | 0.30 max. |
| | 8(C+N) min. | 8(C+N) min. | | | | |
| Ti | | | 0.12 to 0.70 | 0.12 to 0.70 | 0.30 max. | 0.30 max. |
| | | | 6(C+N) min. | 6(C+N) min. | | |
| Ti + Cb | | | | | At least equal to: $\frac{Ti}{6} + \frac{Cb}{8} = (C + N)$ | At least equal to: $\frac{Ti}{6} + \frac{Cb}{8} = (C + N)$ |
| C | 0.003 to 0.04 | 0.003 to 0.04 | 0.04 max. | 0.04 max. | 0.04 max. | 0.04 max. |
| N | 0.003 to 0.04 | 0.003 to 0.04 | 0.04 max. | 0.04 max. | 0.04 max. | 0.04 max. |
| C+N | 0.006 to <0.04 | 0.006 to <0.04 | >0.02 to <0.07 | >0.02 to <0.07 | >0.02 to <0.07 | >0.02 to <0.07 |

TABLE IA-continued

| Element | Columbium-Stabilized Weldments | | Titanium-Stabilized Weldments | | Titanium & Columbium Stabilized Weldments | |
|---|---|---|---|---|---|---|
| | (Percent by Weight) | | | | | |
| Mn | 1.00 max. | 1.00 max. | 1.00 max. | 1.00 max. | 1.00 max. | 1.00 max. |
| Si | 1.00 max. | 1.00 max. | 1.00 max. | 1.00 max. | 1.00 max. | 1.00 max. |
| Ni | 1.00 to 2.00 | 1.00 to 2.00 | 1.00 to 2.00 | 1.00 to 2.00 | 1.00 to 2.00 | 1.00 to 2.00 |
| Cr | 23.00 to <28.00 | 23.00 to <28.00 | 23.00 to <28.00 | 23.00 to <28.00 | 23.00 to <28.00 | 23.00 to <28.00 |
| Mo | 2.50 to 3.50 | 3.00 to 3.50 | 2.50 to 3.50 | 3.00 to 3.50 | 2.50 to 3.50 | 3.00 to 3.50 |
| Cb | 0.05 to 0.70<br>8(C+N) min. | 0.05 to 0.70<br>8(C+N) min. | | | 0.30 max. | 0.30 max. |
| Ti | | | 0.12 to 0.70<br>6(C+N) min. | 0.12 to 0.70<br>6(C+N) min. | 0.30 max. | 0.30 max. |
| Ti + Cb | | | | | At least equal to: $\frac{Ti}{6} + \frac{Cb}{8} = (C + N)$ | At least equal to: $\frac{Ti}{6} + \frac{Cb}{8} = (C + N)$ |

Accordingly, if carbon and nitrogen are above the recited maximums, it is difficult to prevent intergranular corrosion and to achieve good notch toughness. Moreover, excessive amounts of carbon and nitrogen reduce corrosion resistance by forming complex carbides or nitrides which deplete the matrix in chromium or act as possible sites for pit nucleation. In the columbium-stabilized steels of this invention, carbon plus nitrogen contents above about 0.04% cause cracking during welding. In the titanium-stabilized steels of this invention, carbon plus nitrogen contents above 0.07% increase the amounts of titanium needed for stabilization to such an extent that toughness is degraded and it is very difficult to produce materials with good surface quality and a minimum of titanium-rich inclusions. Moreover, carbon plus nitrogen contents below about 0.02% in the titanium-stabilized steels of this invention very substantially reduce weld formability.

Manganese is a residual element which reduces the notch toughness and corrosion resistance of the weldments and is preferably kept below about 1.00%.

Silicon slightly improves corrosion resistance, but reduces toughness and weld formability and is best maintained below the recited upper limit of 1.00%.

A minimum of about 23% chromium is essential for good corrosion resistance. Corrosion resistance is very significantly improved with each one percent increase in chromium above this limit, but chromium should be less than 28%, and most preferably not above 27%, to minimize the formation of embrittling second phases, such as alpha-prime or sigma, during welding or processing. Chromium contents above 27.0% but below 28% provide further improved corrosion resistance, but with chromium content within this range it is much more difficult to avoid embrittling second phases, and special processing practices, such as higher than normal annealing temperatures and very rapid cooling rates are necessary. Above 28% chromium the processing practices required to minimize embrittlement become impractical for continuous, volume production on a commercial basis.

Nickel substantially improves the notch toughness and acid resistance of the welded articles. A minimum of at least 2.00% and preferably 3.00% nickel is essential to obtain good low temperature notch toughness, and to provide satisfactory corrosion resistance in strong reducing acids. However, nickel in amounts above about 4.75% reduces pitting and stress corrosion resistance. When notch toughness is not critical, a minimum of 1.00% nickel may be used to improve resistance to reducing acid media when molybdenum is in the range of 2.50% to 3.50%, preferably 3.00 to 3.50%.

A minimum of at least 0.75% molybdenum is needed to improve the corrosion resistance of the nickel-bearing welded articles of this invention. Increasing molybdenum above 0.75% progressively improves pitting and crevice corrosion resistance, but in amounts above 3.50% it introduces undesirable second phases, such as alpha-prime or sigma, which reduce both corrosion resistance and toughness. Where good stress corrosion resistance is essential, molybdenum must be kept below about 2.75%. Where it is not essential and where outstanding resistance to pitting and crevice corrosion is needed such as in marine and chemical environments at slightly elevated temperatures, e.g. 104° to 122° F. (40° to 50° C.), molybdenum contents above 2.00% but below 3.50% are necessary.

Columbium is useful for stabilizing the carbon and nitrogen contents of the weldments and to thereby reduce their susceptibility to intergranular corrosion and embrittlement after welding or heat treatment. In titanium-free steels it is necessary that the minimum columbium content be at least eight times the carbon plus nitrogen content to assure good resistance to intergranular corrosion. When columbium is increased beyond the recited upper limit, excess columbium is present with the result that toughness is degraded and the weldments become very susceptible to embrittlement.

Titanium, like columbium, is necessary for combining with the carbon and nitrogen contents of the weldments and to thereby improve their resistance to intergranular corrosion and toughness after welding. In columbium-free weldments it is necessary that the minimum titanium content be at least equal to six times carbon plus nitrogen content to assure good resistance to intergranular corrosion. If titanium is increased above the recited upper limit, excessive titanium is present with the result that toughness is degraded and the weldments become very susceptible to embrittlement.

To illustrate the criticality of composition in the weldments of this invention, a large number of alloys were melted by various methods and then evaluated in several mechanical and corrosion tests. TABLES II and IIA present the composition of these alloys. The arc-melted alloys in TABLE II were melted using material from Coil 930594 as a base. Therefore, their composition is essentially identical to that of Coil 930594, except for alloys such as C-1 in which the nitrogen was reduced or in Alloys Ti-1 and Cb-1 to which columbium or titanium were intentionally added during melting.

TABLE II

| Material Code | COMPOSITION OF EXPERIMENTAL STAINLESS STEELS (Percent by Weight) C | Mn | P | S | Si | Ni | Cr | Mo | Cu | Al | O | N | Ti | Cb |
|---|---|---|---|---|---|---|---|---|---|---|---|---|---|---|
| A. Electron-Beam Melted Stainless Steels | | | | | | | | | | | | | | |
| 930593 | .0027 | <0.01 | .016 | .007 | .24 | 0.09 | 25.64 | 0.03 | .01 | .003 | .0010 | .008 | — | — |
| 930594 | .0025 | — | .01 | .007 | .27 | 0.11 | 26.99 | 0.97 | .01 | .003 | .0019 | .01 | — | — |
| 100641 | .002 | — | .016 | .009 | .18 | 0.13 | 26.59 | 1.24 | .01 | — | — | .01 | — | — |
| 930595 | .0029 | — | .023 | .007 | .26 | 0.16 | 26.17 | 0.56 | — | — | .0013 | .008 | — | — |
| B. Vacuum-Arc Melted Stainless Steels* | | | | | | | | | | | | | | |
| Cb-3 | .031 | — | — | — | — | — | — | — | — | — | .005 | .029 | — | — |
| Ti-1 | .0035 | — | — | — | — | — | — | — | — | — | .0059 | .009 | .18 | — |
| Ti-6 | .005 | — | — | — | — | — | — | — | — | — | — | .009 | .28 | — |
| Ti-2 | .0046 | — | — | — | — | — | — | — | — | — | .0040 | .009 | .33 | — |
| Ti-3 | .029 | — | — | — | — | — | — | 1.062 — | — | .0037 | .034 | .15 | — | |
| Ti-5 | .034 | — | — | — | — | — | — | — | — | — | .0032 | .028 | .41 | — |
| Cb-1 | .0032 | — | — | — | — | — | — | — | — | — | .0063 | .006 | — | .33 |
| Cb-2 | .003 | — | — | — | — | — | — | — | — | — | .0063 | .010 | — | .67 |
| Cb-4 | .026 | — | — | — | — | — | — | 0.90 | — | — | .0033 | .032 | — | .31 |
| Cb-5 | .034 | — | — | — | — | — | — | 1.03 | — | — | .0069 | .034 | — | .58 |
| C-1 | .002 | — | — | — | — | — | — | — | — | — | — | .004 | — | — |
| C. Vacuum-Induction Melted Stainless Steels | | | | | | | | | | | | | | |
| 3775 | .019 | 0.27 | .016 | — | .32 | 0.22 | 26.37 | 0.95 | .13 | .02 | .0155 | .013 | .43 | — |
| 3780 | .018 | 0.28 | .017 | — | .38 | 0.23 | 25.91 | 0.98 | .13 | .05 | .0118 | .029 | .56 | — |
| 3776A | .021 | 0.28 | .02 | .013 | .55 | 0.22 | 26.09 | 1.81 | .12 | — | — | .026 | .45 | — |
| 3779 | .036 | 0.29 | .018 | — | .45 | 0.23 | 25.64 | 1.88 | .12 | .06 | .008 | .027 | .60 | — |
| 3778A | .03 | 0.29 | .018 | .012 | .45 | 0.22 | 26.20 | 1.91 | .12 | — | — | .026 | .25 | .29 |
| 3777 | .024 | .029 | .023 | — | .46 | 0.21 | 25.63 | 2.69 | .13 | .04 | .0119 | .029 | .41 | — |
| 3777A | .032 | 0.28 | .023 | .013 | .47 | 0.24 | 25.96 | 2.67 | .13 | — | — | .031 | .45 | — |
| D. Molybdenum-Titanium Series | | | | | | | | | | | | | | |
| 161079 | .019 | 0.32 | .015 | .004 | .08 | 0.40 | 25.87 | 1.04 | .10 | .13 | — | .03 | .24 | — |
| 632566 | .02 | 0.27 | .03 | .008 | .43 | 0.25 | 25.60 | 0.99 | .04 | — | — | .026 | .42 | — |
| 3A2 | .014 | 0.29 | .002 | .012 | .35 | 0.22 | 26.28 | 0.93 | .08 | — | .01 | .017 | .44 | — |
| 3911A | .015 | 0.29 | .02 | .007 | .36 | 0.27 | 26.08 | 2.18 | .02 | .03 | — | .021 | .42 | — |
| 3B79 | .024 | 0.25 | — | — | .26 | 0.29 | 25.61 | 2.59 | .05 | — | — | .012 | .51 | — |
| 3B80 | .027 | .023 | — | — | .27 | 0.26 | 26.00 | 3.02 | .05 | — | — | .014 | .49 | — |
| 3B81 | .032 | 0.22 | — | — | .28 | 0.25 | 26.18 | 3.47 | .04 | — | — | .012 | .52 | — |
| E. Nickel-Titanium Series | | | | | | | | | | | | | | |
| 3A47A | .016 | 0.27 | .011 | .010 | .37 | 2.04 | 25.93 | 0.97 | .04 | — | — | .013 | .43 | — |
| 3925 | .015 | 0.31 | — | — | .33 | 2.03 | 26.04 | 0.95 | .03 | — | — | .014 | .40 | — |
| 3B69 | .013 | 0.32 | .006 | .006 | .33 | 3.25 | 26.59 | 1.08 | .05 | — | — | .013 | .39 | — |
| 3A23 | .015 | 0.28 | .004 | .011 | .36 | 4.00 | 26.00 | 0.96 | .05 | — | — | .014 | .42 | — |
| 3A48A | .020 | .026 | .010 | .009 | .38 | 4.11 | 25.70 | 0.97 | .03 | — | — | .012 | .44 | — |
| 3A49A | .025 | 0.25 | .010 | .008 | .36 | 5.19 | 25.70 | 0.95 | .05 | — | — | .013 | .46 | — |
| F. Nickel-Molybdenum-Titanium Series | | | | | | | | | | | | | | |
| 3B70 | .026 | 0.28 | — | — | .50 | 3.99 | 26.48 | 2.49 | .07 | — | — | .02 | — | .75 |
| 3B82 | .023 | 0.23 | — | — | .28 | 3.96 | 26.18 | 2.57 | .05 | — | — | .012 | .51 | — |
| 3B78A | .024 | 0.26 | — | — | .25 | 3.94 | 26.35 | 2.87 | .05 | — | — | .013 | .47 | — |
| 3B93D | .012 | .029 | .008 | .008 | .38 | 4.00 | 25.91 | 3.18 | .06 | — | — | .015 | .50 | — |
| 3B93A | .033 | 0.27 | — | — | .24 | 4.24 | 26.14 | 3.43 | .05 | — | — | .013 | .46 | — |
| 3B93 | .021 | 0.44 | .012 | .005 | .36 | 4.60 | 25.70 | 3.47 | .08 | — | — | .014 | .40 | — |
| 3B94 | .016 | 0.32 | .018 | .005 | .37 | 4.14 | 27.80 | 2.12 | .06 | — | — | .013 | .39 | — |
| G. Commercial Austenitic Stainless Steels | | | | | | | | | | | | | | |
| 158629 | .06 | 1.68 | .027 | .017 | .32 | 8.38 | 18.15 | 0.25 | — | — | — | — | — | — |
| 159677 | .05 | 1.75 | .031 | .015 | .56 | 12.18 | 16.24 | 2.18 | — | — | — | — | — | — |
| M71C48 | .022. | 1.80 | .026 | .010 | .54 | 14.44 | 18.23 | 3.23 | .49 | — | — | — | — | — |

*Melted using material from Coil 930594 as a base.

TABLE IIA

| Heat | COMPOSITION OF EXPERIMENTAL STAINLESS STEELS (Percent by Weight) C | Mn | P | S | Si | Ni | Cr | Mo | Cu | Ti | N |
|---|---|---|---|---|---|---|---|---|---|---|---|
| 632566 | 0.02 | 0.27 | 0.03 | 0.008 | 0.43 | 0.25 | 25.60 | 0.99 | 0.04 | 0.42 | 0.026 |
| 3B80 | 0.027 | 0.23 | — | — | 0.27 | 0.26 | 26.00 | 3.02 | 0.05 | 0.49 | 0.014 |
| 3B81 | 0.032 | 0.22 | — | — | 0.28 | 0.25 | 26.18 | 3.47 | 0.04 | 0.52 | 0.012 |
| 3A47A | 0.016 | 0.27 | 0.011 | 0.010 | 0.37 | 2.04 | 25.93 | 0.97 | 0.04 | 0.43 | 0.013 |
| 3B69 | 0.013 | 0.32 | 0.006 | 0.006 | 0.33 | 3.25 | 26.59 | 1.08 | 0.05 | 0.39 | 0.013 |
| 3A48A | 0.020 | 0.26 | 0.01 | 0.009 | 0.38 | 4.11 | 25.70 | 0.97 | 0.03 | 0.44 | 0.012 |
| 3D49 | 0.022 | 0.32 | 0.018 | 0.005 | 0.33 | 1.28 | 25.70 | 3.09 | 0.11 | 0.51 | 0.015 |
| 3D50A | 0.016 | 0.26 | 0.022 | 0.005 | 0.30 | 2.15 | 25.60 | 3.06 | 0.10 | 0.38 | 0.014 |
| 3B51A | 0.030 | 0.26 | 0.017 | 0.005 | 0.33 | 3.19 | 25.63 | 3.08 | 0.11 | 0.53 | 0.014 |
| 3B78A | 0.024 | 0.26 | — | — | 0.25 | 3.94 | 26.35 | 2.87 | 0.05 | 0.47 | 0.013 |

The susceptibility of the ferritic stainless weldments of this invention to intergranular corrosion (weld decay) caused by the precipitation of intergranular chromium carbides or nitrides was evaluated in an aqueous solution containing 10% nitric acid and 3% hydrofluoric acid at 70° C. This test was chosen, since contrary to the sulfuric acid-ferric sulfate and nitric acid tests included in ASTM 262–70, it is very sensitive to chromium depletion caused by chromium carbide or nitride precipitation (which is well known to be the primary and most common cause of intergranular corrosion in stainless steels) and not to the precipitation of titanium or columbium carbides or nitrides which only cause intergranular attack under very selective conditions, e.g. in a few very highly oxidizing chemical environments. The test specimens were prepared from 0.060 in. thick autogenous TIG welds prepared from the alloys listed in TABLE II. Corrosion resistance of the welds was rated microscopically (30X) according to the severity and location of intergranular attack.

The weld corrosion data in TABLE III clearly show that unstabilized ferritic stainless steels are susceptible to intergranular corrosion after welding. The susceptibility is greatly reduced, however, by lowering carbon and nitrogen content, as is evidenced by the comparative behavior of Alloy Cb-3 (0.06% carbon plus nitrogen) which exhibited severe weld attack, by Coil 930594 (0.012% carbon plus nitrogen) which showed only slight weld attack and by Alloy C-1 (0.006% carbon plus nitrogen) which showed almost no weld attack. Therefore, to avoid intergranular corrosion with conventional ferritic stainless steels, the carbon plus nitrogen content must be below at least 0.006% which is, as is well known, an impractically low level.

TABLE III

INTERGRANULAR CORROSION RESISTANCE OF TIG WELDS (0.060 in.) IN 10% $HNO_3$-3% HF AT 70° C

| Material | Composition, % C | Ni | Cr | Mo | N | Other | Corrosion Severity in Indicated Location[1] Weld Metal | Weld Line | Heat Affected Zone |
|---|---|---|---|---|---|---|---|---|---|
| 930594 | .0025 | 0.11 | 26.99 | 0.97 | .01 | — | None | None | Light |
| C-1* | .002 | — | — | — | .004 | — | None | None | Trace |
| Ti-1* | .0035 | — | — | — | .009 | Ti 0.18 | None | None | None |
| Cb-1* | .0032 | — | — | — | .006 | Cb 0.33 | None | None | None |
| Cb-3* | .031 | — | — | — | .029 | — | Severe | Severe | Severe |
| Ti-3* | .029 | — | — | — | .034 | Ti 0.15 | Severe | Severe | Severe |
| Ti-5* | .034 | — | — | — | .028 | Ti 0.41 | None | None | None |
| Cb-4* | .026 | — | — | — | .032 | Cb 0.31 | Severe | Severe | Severe |
| Cb-5* | .034 | — | — | — | .034 | Cb 0.58 | None | None | None |
| 161079 | .019 | 0.40 | 25.87 | 1.04 | .03 | Ti 0.24 | None | Trace | None |
| 3780 | .018 | 0.23 | 26.37 | 0.98 | .029 | Ti 0.56 | None | None | None |
| 3776A | .021 | 0.22 | 26.09 | 1.81 | .026 | Ti 0.45 | None | None | None |
| 3778A | .03 | 0.22 | 26.20 | 1.91 | .026 | Ti 0.25, Cb 0.29 | None | None | None |
| 3777 | .024 | 0.21 | 25.63 | 2.69 | .029 | Ti 0.41 | None | None | None |
| 3B69 | .013 | 3.25 | 26.59 | 1.08 | .013 | Ti 0.39 | None | None | None |
| 3A48A | .020 | 4.11 | 25.70 | 0.97 | .012 | Ti 0.44 | None | None | None |
| 3B82 | .023 | 3.96 | 26.48 | 2.49 | .012 | Ti 0.51 | None | None | None |
| 3B78A | .024 | 3.94 | 26.35 | 2.87 | .013 | Ti 0.40 | None | None | None |
| 3B94 | .016 | 4.14 | 28.05 | 2.12 | .013 | Ti 0.39 | None | None | None |

[1]Severity of corrosion rated according to location in the weldment. Test time - 4 hours.
*Base composition similar to that of Coil 930594.

The weld corrosion data in TABLE III also show that titanium and columbium, used singly or in combination, substantially improve the resistance of ferritic stainless steel welds to intergranular corrosion when their carbon plus nitrogen content exceeds 0.006%. The beneficial effect of titanium is clearly shown by the weld corrosion data for Alloys Cb-3, Ti-3, Ti-5 and Heat 161079 which contain from about 0.05 to 0.06% carbon plus nitrogen. Heat Cb-3 developed severe weld attack as did Alloy Ti-3 which contains an amount of titanium (0.15%) equal to about two times the carbon plus nitrogen content. Heat 161079 contains an amount of titanium equal to about five times the carbon plus nitrogen content and still shows slight weld attack, indicating that the minimum amount of titanium needed to achieve good resistance to weld decay is considerably greater than five times the carbon content and even greater than five times the carbon plus nitrogen content. Alloy Ti-5 which contained an amount of titanium (0.41%) almost equal to six times the carbon plus nitrogen content showed no weld attack whatsoever. Increasing the nickel and molybdenum contents of the titanium stabilized ferritic stainless steels, as in this invention, does not reduce their resistance to integranular attack as shown by the good performance of Alloy 3A48A which contains 4.11% nickel and 0.97% molybdenum; Alloy 3B78 which contains 3.96% nickel and 2.57% molybdenum; and Alloy 3B78A which contains 3.94% nickel and 2.87% molybdenum.

In comparison to titanium, somewhat greater amounts of columbium are needed in the weldments of this invention to obtain good resistance to weld decay. The importance of columbium content with respect to weld decay is indicated by the comparative behavior of Alloys Cb-4 and Cb-5, which have fairly similar carbon and nitrogen, but different columbium contents. Alloy Cb-4, which contains an amount of columbium (0.31%) equal to about five times the carbon plus nitrogen content, is subject to considerable weld decay. In comparison, Alloy Cb-5, which contains an amount of columbium (0.58%) slightly greater than eight times the carbon plus nitrogen content, shows no weld decay. Columbium must, therefore, be present in an amount at least equal to about eight times the carbon plus nitrogen content to assure good resistance to weld decay.

The weld corrosion data in TABLE II, and in particular for Alloy 3778A, show that columbium in combination with titanium may be used to prevent weld corrosion. Such a combination is useful for reducing the amount of titanium needed for stabilization and to thereby reduce the likelihood of obtaining objectionable surface defects caused by titanium-rich inclusions, and for reducing the amount of columbium needed for stabilization and to thereby provide improved weld toughness. In order to obtain good resistance to weld corrosion after welding with the alloys stabilized by both titanium and columbium, the amounts of these elements must at least be equal to those given by the following relationship:

$$\% Ti/6 + \% Cb/8 = (\%C + \%N)$$

In addition to having good resistance to intergranular corrosion after welding, stainless steel weldments must also exhibit good resistance to cracking during welding and in subsequent forming operations. To illustrate the criticality of composition in the ferritic stainless weldments of this invention with respect to cracking during welding, 0.060 in. thick TIG welds were made without filler metal in several of the alloys listed in TABLE II using different heat inputs and examined microscopically for unsoundness. The welds of all the nonstabilized alloys, as for example Coil 930594 and Alloy Cb-3 and the titanium-stabilized alloys, for example Alloys Ti-5 and 3775, were completely crackfree for every weld condition used. However, the welds of the columbium-stabilized alloys containing more than about 0.04% carbon plus nitrogen, developed severe cracking. For example, Alloy Cb-5, which contains 0.068% carbon plus nitrogen and 0.58% columbium and Alloy 3B70, which contains 0.046% carbon plus nitrogen and 0.75% columbium, showed catastrophic centerline cracking; whereas, Alloy Cb-2, which contains 0.013% carbon plus nitrogen and 0.67% columbium, showed no cracking whatsoever. Thus, to avoid weld cracking with the columbium-stabilized ferritic stainless weldments of this invention, it is essential that the carbon plus nitrogen content be below 0.04%. We find that higher carbon plus nitrogen contents are permissible in the columbium-stabilized weldments of this invention only if titanium is also present. For example, Alloy 3778A which contains 0.056% carbon plus nitrogen, 0.25% titanium and 0.29% columbium was crack-free after welding; whereas, Alloy Cb-5, which contains 0.068% carbon plus nitrogen and 0.58% columbium and no titanium, cracked during welding. The titanium-stabilized steels containing up to 0.07% carbon plus nitrogen were, as indicated previously, crack-free after welding.

The weld formability of the ferritic stainless weldments of this invention was evaluated by making Olsen cup tests on some of the 0.060 in. thick TIG welds prepared for the weld cracking studies and by comparing the results to similar tests made on the annealed and unwelded base materials. The results are given in TABLE IV.

TABLE IV

OLSEN CUP DUCTILITY OF THE INVENTED ALLOYS IN THE ANNEALED AND AS-WELDED CONDITIONS (0.060 in. THICK)

| | Composition, % | | | | | | Olsen Cup Height - in.* | |
|---|---|---|---|---|---|---|---|---|
| Material | C | Ni | Cr | Mo | N | Other | As-Annealed | As-Welded |
| 930594 | .0025 | 0.11 | 26.99 | 0.97 | .01 | — | 0.418 | 0.420 |
| Cb-3 | .031 | — | — | — | .029 | — | 0.360 | 0.020 |
| Ti-1 | .0035 | — | — | — | .009 | Ti 0.18 | 0.400 | 0.250 |
| Ti-6 | .0053 | — | — | — | .009 | Ti 0.28 | 0.400 | 0.185 |
| Ti-3 | .029 | — | — | — | .034 | Ti 0.15 | 0.370 | 0.040 |
| Ti-5 | .034 | — | — | — | .028 | Ti 0.41 | 0.400 | 0.360 |
| Cb-1 | .003 | — | — | — | .006 | Cb 0.33 | 0.420 | 0.390 |
| Cb-2 | .003 | — | — | — | .01 | Cb 0.67 | 0.400 | 0.410 |
| Cb-4 | .026 | — | — | — | .032 | Cb 0.31 | 0.380 | 0.066 |
| Cb-5** | .034 | — | — | — | .034 | Cb 0.58 | 0.400 | 0.080 |
| 3775 | .019 | 0.22 | 26.37 | 0.95 | .013 | Ti 0.43 | 0.420 | 0.430 |
| 3780 | .018 | 0.23 | 25.91 | 0.98 | .029 | Ti 0.56 | 0.400 | 0.320 |
| 3778A | .03 | 0.22 | 26.20 | 1.91 | .026 | Ti 0.25, Cb 0.29 | 0.410 | 0.400 |
| 3A48A | .020 | 4.11 | 25.70 | 0.95 | .012 | Ti 0.44 | 0.375 | 0.385 |
| 3B78A | .024 | 3.94 | 26.35 | 2.87 | .013 | Ti 0.40 | — | 0.365 |

*Maximum cup height without failure.
**Contained cracks in the as-welded condition.

The data confirm the well known fact that lowering the carbon plus nitrogen content of the high-chromium stainless steels substantially improves weld ductility and toughness. The Olsen cup ductility of Coil 930594, for example, which contains only 0.012% carbon plus nitrogen was equivalent to that of the annealed and non-welded base material; whereas, that of Alloy Cb-3, which contains 0.06% carbon plus nitrogen, was very poor and considerably less than that of the annealed base material. More importantly, the Olsen cup data show that titanium additions in the amount required to minimize weld corrosion, that is, when titanium is present in quantities at least equal to six times the carbon plus nitrogen content, substantially improve the weld formability of the nonstabilized alloys when their carbon plus nitrogen contents are above about 0.02%. The beneficial effect of titanium stabilization, in this respect, is clearly shown by the differences in the cup height of the welds made in Alloys Cb-3, 3775 and Ti-5. Titanium stabilization of the alloys containing less than about 0.02% carbon plus nitrogen impairs weld ductility, as is evidenced by the relatively poor Olsen cup ductility of the welds made in Alloys Ti-1 and Ti-6. Columbium additions in the amounts needed to minimize weld corrosion, that is, when present in amounts at least equal to eight times the carbon plus nitrogen content, do not reduce weld formability in the alloys containing less than about 0.04% carbon plus nitrogen, as is evidenced by the comparatively good Olsen cup ductility of Alloys Cb-1 and Cb-2. However, columbian stabilization of the alloys containing more than about 0.04% carbon produces cracking during welding; and as would be expected, the weld formability of such alloys is extremely poor. As previously mentioned, stabilization by both columbium and titanium at carbon plus nitrogen levels above 0.04% provides good weld formability, as is evidenced by the good cup ductility of the welds made in Alloy 3778A, which contains 0.056% carbon plus nitrogen, 0.25% titanium and 0.29% columbium. Nickel in amounts necessary to improve the low-temperature toughness of the weldments does not reduce Olsen cup formability as indicated by the good performance of Alloy 3A48A (4.11% nickel) which has almost the same Olsen cup height in the welded as in the annealed condition.

The notch toughness of the low-nickel titanium-stabilized ferritic stainless steels is especially poor in the as-welded condition and represents a major drawback to their use, since in comparison to other product forms weldments cannot readily be cold-worked and annealed or otherwise processed to improve their toughness. The capacity of nickel for improving the impact notch toughness of the stabilized ferritic stainless steels in the as-welded condition is therefore particularly advantageous. To illustrate the criticality of nickel on the notch toughness of the materials of the invention, Charpy V-notch impact tests were performed on subsize specimens of the alloys given in TABLE II in both the as-annealed and as-welded conditions. TABLE V compares the impact transition temperature of subsize weld Charpy specimens (0.100 in. thick) prepared from the alloys given in TABLE II.

TABLE V

CHARPY IMPACT TRANSITION TEMPERATURE OF EXPERIMENTAL ALLOYS IN THE COLD-ROLLED AND ANNEALED AND AS-WELDED CONDITIONS (0.100 in. THICK)

| | Composition, % | | | | | | Transition Temperature - ° F | |
|---|---|---|---|---|---|---|---|---|
| Heat | C | Ni | Cr | Mo | N | Ti | As-Annealed | As-Welded* |
| 3A2 | 0.014 | 0.22 | 26.28 | 0.93 | 0.017 | 0.44 | 32 | 75 |
| 3925 | 0.011 | 2.03 | 26.04 | 0.95 | 0.014 | 0.40 | — | 32 |
| 3B69 | 0.013 | 3.25 | 25.69 | 1.08 | 0.013 | 0.39 | — | 0 |
| 3A23 | 0.015 | 4.00 | 26.00 | 0.96 | 0.014 | 0.42 | −40 | — |
| 3A48A | 0.020 | 4.11 | 25.70 | 0.97 | 0.012 | 0.44 | — | −40 |
| 3A49A | 0.025 | 5.19 | 25.70 | 0.95 | 0.013 | 0.46 | — | −50 |

*Welded samples prepared from 0.125 in. thick autogenous TIG welds.
Weld specimens notched in the weld metal.

The data show that a minimum of 2.00% nickel is needed at this thickness to achieve a Charpy V-notch impact transition temperature of about 32° F., which is essential for minimizing brittle failures caused by impact loading during fabrication or in service. Increasing nickel content to 3.25%, as with Alloy 3B69, to 4.11% as with Alloy 3A48A, and to 5.19% as with Alloy 3A49A produces still lower weld impact transition temperatures (e.g. at or below 0° F.) which provide greater protection against brittle failures. However, as will be shown later, nickel in the weldments of this invention cannot be increased much above 4.75% without reducing pitting or stress corrosion resistance. In applications where notch toughness is not important, nickel contents as low as 1% can be used when molybdenum contents are in the range of 2.50 to 3.50%, preferably 3.00 to 3.50%.

TABLE VI compares the impact transition temperature based on energy absorption or lateral expansion for half-size (0.197 in.) or third-size (0.131 in.) specimens for several of the alloys in TABLE II in the hot-rolled and annealed or cold-rolled and annealed conditions. The data show that the impact transition temperature of low-nickel, titanium-stabilized ferritic stainless steels, such as represented by Alloy 3A2 and Heat 632566, is highly sensitive to processing conditions. For example, the transition temperature for Heat 632566 at a thickness of about 0.131 in. is about −30° F. in the cold-rolled and annealed condition, whereas it is as high as 75° F. for hot-rolled material annealed at 1600° F. The transition temperature for these materials at a thickness of 0.197 in. after hot rolling and annealing at 1850° F. is still higher (125° F.) as indicated by the data for Heat 3A2. The production and application of the low-nickel, titanium-stabilized ferritic stainless steels is therefore difficult since, as pointed out earlier, a maximum Charpy V-notch impact transition temperature of about 32° F. is essential to minimize brittle failures in processing or in service, especially for structural applications.

TABLE VI

CHARPY IMPACT TRANSITION TEMPERATURE OF EXPERIMENTAL MATERIALS

| | | | Specimen Thickness | Composition, % | | | | | | Ductile to Brittle Transition Temperature* | |
|---|---|---|---|---|---|---|---|---|---|---|---|
| Heat | Coil | Condition | (in.) | C | Ni | Cr | Mo | N | Ti | Water Quenched | Air-Cooled |
| 632566 | 223808 | Hot-Rolled, Annealed 1450° F | 0.131 | .02 | 0.25 | 25.60 | 0.99 | .016 | .39 | 0° F | — |
| | 223808 | Hot-Rolled, Annealed 1600° F | 0.131 | — | — | — | — | — | — | 75° F | — |
| | 223808 | Cold-Rolled, Annealed 1500° F | 0.131 | — | — | — | — | — | — | −30° F | — |
| 3A2 | — | Hot-Rolled, Annealed 1850° F | 0.197 | .014 | 0.22 | 26.28 | 0.93 | .017 | .44 | 125° F | 212° F |
| 3A48A | — | Hot-Rolled Annealed 1850° F | 0.197 | .020 | 4.11 | 25.70 | 0.97 | .012 | .44 | −80° F | 32° F |
| 3B82 | — | Hot-Rolled, Annealed 1850° F | 0.197 | .023 | 3.96 | 26.18 | 2.57 | .012 | .51 | −80° F | 0° F |
| 3B78A | — | Hot-Rolled, Annealed 1850° F | 0.197 | .024 | 3.94 | 26.35 | 2.87 | .013 | .47 | −60° F | 32° F |
| 3B93 | — | Hot-Rolled, Annealed 1850° F | 0.197 | .021 | 4.60 | 25.70 | 3.47 | .014 | .40 | −50° F | 0° F |

*Based on a minimum lateral expansion of 0.015 in.

The notch toughness data in TABLE VI also show that nickel substantially improves the notch toughness of the stabilized ferritic stainless steels in the unwelded condition and that it produces a very marked reduction in transition temperature, especially for processing conditions which produce relatively high transition temperatures in low-nickel materials of otherwise similar composition. The beneficial effect of nickel is evidenced by the very low impact transition temperatures attained in the hot-rolled and annealed condition for Alloy 3A48A (−80° F.) which contains 4.11% nickel and 0.97% molybdenum and Alloy 3B93 (−50° F.) which contains 4.60% nickel and 3.47% molybdenum.

The criticality of nickel and molybdenum content on the corrosion resistance of the materials of this invention is illustrated by the results of the corrosion tests given in TABLES VII, VIII, IX and X. The effect of nickel content on pitting resistance was established by conducting acid ferric-chloride tests at 23° and 30° C. on several titanium-stabilized alloys with molybdenum contents within the scope of this invention and with nickel contents ranging from 0.25 to 5.19%. TABLE VII gives results of the ferric-chloride tests which show that nickel does not significantly affect the pitting resistance of the weldments of this invention, providing the amount of nickel does not unbalance the alloys and introduce austenite. The highly detrimental effect of austenite on the pitting resistance of the invented alloys is evidenced by the poor performance of Alloy 3A49A which has a duplex austenite-ferrite structure due to its high nickel content (5.19%). The nickel content of the alloys of this invention must therefore be kept below about 4.75% to ensure that a fully ferritic structure can be obtained and to maintain their pitting resistance.

TABLE VII

CORROSION RESISTANCE OF EXPERIMENTAL ALLOYS IN 0.1-NORMAL HCl CONTAINING 10% $FeCl_3 \cdot 6H_2O$ (24 Hrs.)

| Material | Condition | Composition, % C | Ni | Cr | Mo | N | Ti | Corrosion Rate at Indicated Temperature-mils/month 23° C | | 30° C | |
|---|---|---|---|---|---|---|---|---|---|---|---|
| 632566 | Annealed* | .02 | 0.25 | 25.60 | .99 | .016 | .39 | 0.020 | (no pitting) | 0.707 | (moderate pitting) |
| | Welded | | | | | | | 0.006 | (no pitting) | 0.450 | (light pitting) |
| 3A47A | Annealed* | .016 | 2.04 | 25.93 | .97 | .013 | .43 | 0.014 | (no pitting) | 0.031 | (no pitting) |
| | Welded | | | | | | | 0.006 | (no pitting) | 0.024 | (no pitting) |
| 3A48A | Annealed* | .020 | 4.11 | 25.70 | .97 | .012 | .44 | 0.020 | (no pitting) | 0.086 | (trace pitting) |
| | Welded | | | | | | | 0.023 | (no pitting) | 0.234 | (light pitting) |
| 3A49A** | Annealed* | .025 | 5.19 | 25.70 | .95 | .012 | .46 | 9.273 | (severe pitting) | 22.509 | (severe pitting) |
| | Welded | | | | | | | 7.5765 | (severe pitting) | 19.437 | (severe pitting) |

*Annealed at 1600° F.
**Contains an austenite-ferrite microstructure at this annealing temperature.

TABLES VIII and VIIIA compare the acid corrosion resistance of several titanium-stabilized alloys with molybdenum contents within the scope of this invention and with nickel contents ranging from 0.25 to 5.19%. The data show that nickel substantially improves the corrosion resistances of these alloys in reducing acid media, such as represented by boiling 5% sulfuric acid and boiling 60% phosphoric acid, and that a minimum of at least 2.00% and preferably 3.00% nickel is needed to achieve satisfactory performance and corrosion rates below about 2 mils/month. The importance of these nickel contents is evidenced by the performance of Heat 632566 (0.25% nickel) and Alloy 3A47A (2.04% nickel) which in the welded condition have respective corrosion rates of 581.0 and 2.1 mils/month in boiling 60% phosphoric acid, and by the performance of Heat 3A47A (2.04% nickel) and Heat 3B69 (3.25% nickel) which in the annealed condition have respective corrosion rates of 12.58 and 0.24 mils/month in boiling 5% sulfuric acid. The nickel content of the steels of the invention must therefore be above 2.00% and preferably above 3.00% to obtain good resistance to reducing acid media.

Lower nickel levels, e.g. 1.00%, are useful for improving resistance to reducing acids only when molybdenum exceeds about 2.50%, as shown by the data in TABLE VIIIA.

TABLE VIII

CORROSION RESISTANCE OF EXPERIMENTAL ALLOYS IN BOILING ACID ENVIRONMENTS

| Heat | Condition | Composition, % C | Ni | Cr | Mo | N | Ti | Corrosion Rate - mils/month Boiling* 5% Sulfuric | Boiling* 60% Phosphoric |
|---|---|---|---|---|---|---|---|---|---|
| 632566 | Annealed | .02 | 0.25 | 25.60 | 0.99 | .016 | .39 | Dissolved | 824.670 |
| | Welded | | | | | | | 131.028 | 581.015 |
| 3A47A | Annealed | .016 | 2.04 | 25.93 | 0.97 | .013 | .43 | 12.580 | 0.102 |
| | Welded | | | | | | | 1.580 | 2.121 |
| 3B69 | Annealed | .013 | 3.25 | 26.59 | 1.08 | .013 | .39 | 0.244 | 0.381 |
| | Welded | | | | | | | 0.382 | 0.390 |
| 3A48A | Annealed | .020 | 4.11 | 25.70 | 0.97 | .012 | .44 | 0.821 | 0.503 |
| | Welded | | | | | | | 0.228 | 0.020 |
| 3A49A | Annealed | .025 | 5.19 | 25.70 | 0.95 | .012 | .46 | 0.149 | 0.027 |
| | Welded | | | | | | | 0.301 | nil |

*Specimens activated with zinc immediately after immersion in test solution.

TABLE VIIIA

CORROSION RESISTANCE OF EXPERIMENTAL ALLOYS IN BOILING SULFURIC ACID (24 Hrs.)*

| Material | Heat | Composition Variation Ni | Cr | Mo | Corrosion Rate (mils/month) at Indicated Concentration 5% |
|---|---|---|---|---|---|
| Crucible 26-1 | 632566 | 0.25 | 25.60 | 0.99 | Dissolved |
| 26Cr - 3.0Mo | 3B80 | 0.26 | 26.00 | 3.02 | Dissolved |
| 26Cr - 3.5Mo | 3B81 | 0.28 | 26.18 | 3.47 | 614.9 |
| 26Cr - 2Ni - 1Mo | 3A47A | 2.04 | 25.93 | 0.97 | 12.6 |
| 26Cr - 3Ni - 1Mo | 3B69 | 3.25 | 26.59 | 1.08 | 0.2 |
| 26Cr - 4Ni - 1Mo | 3A48A | 4.11 | 25.70 | 0.97 | 0.8 |
| 26Cr - 1Ni - 3Mo | 3D49 | 1.28 | 25.70 | 3.09 | 0.7 |
| 26Cr - 2Ni - 3Mo | 3D50A | 2.15 | 25.60 | 3.06 | 0.4 |
| 26Cr - 3Ni - 3Mo | 3D51A | 3.19 | 25.63 | 3.08 | 0.2 |
| 26Cr - 4Ni - 3Mo | 3B78A | 3.94 | 26.35 | 2.87 | 0.3 |

*Specimens activated with a zinc rod immediately after immersion in test solution.

As may be seen from the data reported in TABLE VIIIA, Heats 632566, 3B80 and 3B81 evidence unsatisfactory corrosion rates. These heats have nickel contents within the range of 0.25 to 0.28% and molybdenum contents within the recited range for molybdenum. These heats indicate that at these low nickel contents, even in the presence of as much as 3.50% molybdenum, satisfactory corrosion resistance is not achieved. As shown by Heat 3A47A, increasing nickel to about 2% at a molybdenum level of about 1% significantly improves corrosion resistance. If Heat 3A47A is compared to Heat 3B69, which has a nickel content of 3.25%, but substantially the same molybdenum content, the beneficial effect of nickel on corrosion resistance is further demonstrated. Heat 3D49 with about 1% nickel and about 3% molybdenum shows corrosion resistance comparable to Heat 3B69. This indicates that satisfactory corrosion resistance can be obtained at nickel levels as low as about 1% only when molybdenum is within the range of about 2.50 to 3.50%, preferably 3.00 to 3.50%.

The criticality of molybdenum on the corrosion resistance of the nickel-bearing titanium-stabilized alloys of this invention is illustrated by the results of the crevice corrosion tests given in TABLE IX. The data were obtained by exposing samples fitted with slotted Delrin washers in modified synthetic seawater for 120 hours and by determining the minimum exposure temperature needed to initate crevice corrosion. The data show that molybdenum has a very beneficial effect on the crevice corrosion resistance of the ferritic stainless steels and that at least about 0.75% to 1.00% molybdenum is needed to achieve good resistance to crevice corrosion at ambient temperature (25° C.), an essential requirement for materials used in severe saline and chemical environments. To achieve satisfactory crevice corrosion resistance at the higher operating temperatures (40° to 50° C.) encountered in many seawater-cooled power and chemical plant condensers, the molybdenum content of the stabilized ferritic stainless steels must exceed 2.00%, as evidenced by the comparative behaviors of Alloy 3A48A and Alloy 3B94.

TABLE IX

CREVICE CORROSION RESISTANCE OF EXPERIMENTAL MATERIALS IN SYNTHETIC SEAWATER (pH-7) CONTAINING 10 GRAM/LITER OF POTASSIUM FERRICYANIDE

| Heat | Composition, % C | Ni | Cr | Mo | N | Other | Critical Crevice Corrosion Temp.* ° C |
|---|---|---|---|---|---|---|---|
| 930593 | .0027 | 0.09 | 25.64 | 0.03 | .008 | — | <25 |
| 930595 | .0029 | 0.16 | 26.17 | 0.56 | .008 | — | <25 |
| 930594 | .0025 | 0.11 | 26.99 | 0.97 | .01 | | 25 |
| 632566 | .02 | 0.22 | 25.60 | 0.99 | .026 | .42 Ti | 25 |
| 3A48A | .02 | 4.11 | 25.70 | 0.97 | .012 | .44 Ti | 25 |
| 3B82 | .023 | 3.96 | 26.18 | 2.57 | .012 | .51 Ti | 50 |
| 3B78A | .024 | 3.94 | 26.35 | 2.87 | .013 | .47 Ti | 50 |
| 3B93 | .021 | 4.60 | 25.70 | 3.47 | .014 | .40 Ti | 55 |
| 3B94 | .016 | 4.14 | 27.80 | 2.12 | .013 | .39 Ti | 50 |

*Maximum test temperature at which no crevice corrosion occurs after 120 hrs. test exposure.

The stress corrosion cracking resistance of the titanium-stabilized materials in relation to their nickel and molybdenum contents was evaluated by testing U-bend samples in an aqueous solution of 60% $CaCl_2$ containing 0.1% $HgCl_2$ mercuric chloride at 100° C. (212° F.). According to recent literature, tests in this solution provide a much more realistic evaluation of stress corrosion resistance than do tests in boiling 45% magnesium chloride. Table X contains the results of the stress corrosion tests for U-bends prepared from both as-annealed and as-welded materials. The test data show that molybdenum in amounts up to about 3.50% in stabilized alloys containing about 0.25% nickel does not reduce stress corrosion cracking resistance. Likewise, nickel in amounts up to about 4.75% does not reduce stress corrosion resistance, at least for alloys containing about 1% molybdenum. However, increasing nickel above about 4.75% at this molybdenum level reduces stress corrosion resistance, as evidenced by the poor performance of Alloy 3A49A which contains 5.19% nickel. The data in TABLE X also show that molybdenum contents above about 2.75% substantially reduce the stress corrosion resistance of the titanium-stabilized alloys that contain about 4.00% nickel. Alloys 3B78A (3.94% Ni, 2.87% Mo) and 3B93 (4.60% Ni, 3.47% Mo) fail in the $CaCl_2$ test solution almost as readily as do the conventional austenitic stainless steels which are highly susceptible to stress corrosion cracking. For optimum stress corrosion resistance, molybdenum content must therefore be kept below about 2.75%.

TABLE X

STRESS CORROSION CRACKING RESISTANCE (U-BENDS) OF EXPERIMENTAL ALLOYS IN 60% $CaCl_2$ + 0.1% $HgCl_2$ (100° C)

| Heat | Coil | Initial Condition | Composition, % C | Ni | Cr | Mo | N | Ti | Time to Failure |
|---|---|---|---|---|---|---|---|---|---|
| Group A - Molybdenum-Titanium Series | | | | | | | | | |
| 632566 | 223810 | Annealed - 1600° F | .02 | 0.25 | 25.60 | 0.99 | .016 | .39 | >30 days |
| — | 223829 | Annealed - 1600° F | | | | | | | >21 days |
| | | As-Welded | | | | | | | >21 days |
| 3A2 | — | Annealed - 1600° F | .014 | 0.22 | 26.28 | 0.93 | .017 | .44 | >30 days |
| 3911A | — | Annealed - 1600° F | .015 | 0.27 | 26.08 | 2.18 | .021 | .42 | >21 days |
| 3B79 | — | Annealed - 1600° F | .024 | 0.29 | 25.61 | 2.59 | .012 | .51 | >21 days |
| 3B80 | — | Annealed - 1600° F | .027 | 0.26 | 26.00 | 3.02 | .014 | .49 | >21 days |
| 3B81 | — | Annealed - 1600° F | .030 | 0.25 | 26.18 | 3.47 | .012 | .52 | >21 days |
| Group B - Nickel-Titanium Series | | | | | | | | | |
| 3A47A | — | Annealed - 1600° F | .016 | 2.04 | 25.93 | 0.97 | .013 | .43 | >30 days |
| 3B69 | — | Annealed - 1600° F | .013 | 3.25 | 25.69 | 1.08 | .014 | .42 | >21 days |
| 3A48A | — | Annealed - 1600° F | .020 | 4.11 | 25.70 | 0.97 | .012 | .44 | >30 days |
| | | Annealed - 1900° F | | | | | | | >21 days |
| 3A49A | — | Annealed - 1600° F | .025 | 5.19 | 25.70 | 0.95 | .012 | .46 | <1 days |
| | | Annealed - 1900° F | | | | | | | <3 days |
| Group C - Nickel-Molybdenum-Titanium Steels | | | | | | | | | |
| 3B82 | — | Annealed - 1600° F | .023 | 3.96 | 26.18 | 2.57 | .012 | .51 | >21 days |
| | | Annealed - 1900° F | | | | | | | >26 days |
| 3B78A | — | Annealed - 1600° F | .024 | 3.94 | 26.35 | 2.87 | .013 | .47 | <1 day |
| | | As-Welded | | | | | | | <1 day |
| 3B93 | — | Annealed - 1600° F | .021 | 4.60 | 25.70 | 3.47 | .014 | .40 | <3 days |
| | | Annealed - 1900° F | | | | | | | <3 days |
| 3B94 | — | Annealed - 1600° F | .016 | 4.14 | 27.80 | 2.12 | .013 | .39 | >21 days |
| | | Annealed - 1900° F | | | | | | | >21 days |
| | | As-Welded | | | | | | | >21 days |

TABLE X-continued

STRESS CORROSION CRACKING RESISTANCE (U-BENDS) OF EXPERIMENTAL ALLOYS IN 60% $CaCl_2$ + 0.1% $HgCl_2$ (100° C)

| Heat | Coil | Initial Condition | Composition, % C | Ni | Cr | Mo | N | Ti | Time to Failure |
|---|---|---|---|---|---|---|---|---|---|
| Group D - Commercial Austenitic Stainless Steels | | | | | | | | | |
| 158629 | 824785 | Annealed - 1900° F | .06 | 8.38 | 18.15 | 0.25 | — | — | <1 day |
| 159677 | 961191 | Annealed - 1950° F | .05 | 12.18 | 16.24 | 2.18 | — | — | <2 days |
| M71C48 | — | Annealed - 1950° F | .022 | 14.44 | 18.23 | 3.23 | — | — | <3 days |

The welded articles of this invention should find considerable application in severe saline and chemical environments in the petrochemical, chemical, desalination, pulp and paper and electrical power generation industries. Because of their good weldability and corrosion resistance, they may be particularly useful as welded tubing and heat exchangers, operated with brackish or saline cooling water, and as-welded chemical process equipment.

We claim:

1. A substantially fully ferritic stainless steel welded article with excellent formability and notch toughness and high corrosion resistance, said welded article consisting essentially of, in weight percent, 0.003 to below 0.04 carbon, 0.003 to below 0.04 nitrogen, the sum of the carbon and nitrogen content being 0.006 to below 0.04, up to 1.0 manganese, up to 1.0 silicon, 23.0 to less than 28.0 chromium, 2.00 to 4.75 nickel, 0.75 to 3.50 molybdenum, 0.05 to 0.70 columbium, with columbium being at least equal to eight times the carbon plus nitrogen, and the balance iron and incidental impurities.

2. The substantially fully ferritic stainless welded article of claim 1 wherein the molybdenum content is within the range of 0.75 to 2.75%.

3. The substantially fully ferritic stainless welded article of claim 1 wherein the nickel content is within the range of 3.00 to 4.75%.

4. The substantially fully ferritic stainless steel welded article of claim 1 wherein the molybdenum content is within the range of 0.75 to 2.75% and the nickel content is within the range of 3.00 to 4.75%.

5. The substantially fully ferritic stainless steel welded article of claim 1 wherein the molybdenum content is within the range of 2.00 to 3.50% and the nickel content is within the range of 3.00 to 4.75%.

6. The substantially fully ferritic stainless steel welded article of claim 1 wherein said welded article has an aswelded Olsen cup height exceeding 0.250 in. at a thickness of 0.060 in.

7. A substantially fully ferritic stainless steel welded article with excellent formability, notch toughness and high corrosion resistance, said welded article consisting essentially of, in weight percent, up to 0.04 carbon, up to 0.04 nitrogen, the sum of the carbon plus nitrogen content being above 0.02 but below 0.07, up to 1.0 manganese, up to 1.0 silicon, 23.0 to less than 28.0 chromium, 2.00 to 4.75 nickel, 0.75 to 3.50 molybdenum, 0.12 to 0.70 titanium, with titanium being at least equal to six times the carbon plus nitrogen, and the balance iron and incidental impurities.

8. The substantially fully ferritic stainless steel welded article of claim 7 wherein the molybdenum content is within the range of 0.75 to 2.75%.

9. The substantially fully ferritic stainless steel welded article of claim 7 wherein the nickel content is within the range of 3.00 to 4.75.

10. The substantially fully ferritic stainless steel welded article of claim 7 wherein the molybdenum content is within the range of 0.75 to 2.75% and the nickel content is within the range of 3.00 to 4.75%.

11. The substantially fully ferritic stainless steel welded article of claim 7 wherein the molybdenum content is within the range of 2.00 to 3.50% and the nickel content is within the range of 3.00 to 4.75%.

12. The substantially fully ferritic stainless steel welded article of claim 7 wherein said welded article has an aswelded Olsen cup height exceeding 0.250 in. at a thickness of 0.060 in.

13. A substantially fully ferritic stainless steel welded article with excellent formability, notch toughness and high corrosion resistance, said welded article consisting essentially of, in weight percent, up to 0.04 carbon, up to 0.04 nitrogen, with the carbon plus nitrogen content being above 0.02 but below 0.07, up to 1.0 manganese, up to 1.0 silicon, 23.0 to less than 28.0 chromium, 2.00 to 4.75 nickel, 0.75 to 3.50 molybdenum, up to 0.30 titanium, up to 0.30 columbium, with the columbium and titanium contents being at least equal to the amounts given by the following equation:

$$\% Ti/6 + \% Cb/8 = (\%C + \%N)$$

and the balance iron and incidental impurities.

14. The fully ferritic stainless welded article of claim 13 wherein molybdenum content is within the range of 0.75 to 2.75%.

15. The substantially fully ferritic stainless steel welded article of claim 13 wherein the nickel content is within the range of 3.00 to 4.75%.

16. The substantially fully ferritic stainless steel welded article of claim 13 wherein the molybdenum content is within the range of 0.75 to 2.75% and the nickel content is within the range of 3.00 to 4.75%.

17. The substantially fully ferritic stainless steel welded article of claim 13 wherein the molybdenum content is within the range of 2.00 to 3.50% and the nickel content is within the range of 3.00 to 4.75%.

18. The substantially fully ferritic stainless steel welded article of claim 13 wherein said welded article has an aswelded Olsen cup height exceeding 0.250 in. at a thickness of 0.060 in.

19. A substantially fully ferritic stainless steel welded article with high corrosion resistance, said welded article consisting essentially of, in weight percent, 0.003 to below 0.04 carbon, 0.003 to below 0.04 nitrogen, the sum of the carbon and nitrogen content being 0.006 to below 0.04, up to 1.0 manganese, up to 1.0 silicon, 23.0 to less than 28.0 chromium, 1.00 to 4.75 nickel, 2.50 to 3.50 molybdenum, 0.05 to 0.70 columbium, with columbium being at least equal to eight times the carbon plus nitrogen, and the balance iron and incidental impurities.

20. The substantially fully ferritic stainless steel welded article of claim 19 wherein said welded article has an aswelded Olsen cup height exceeding 0.250 in. at a thickness of 0.060 in.

21. The substantially fully ferritic stainless steel welded article of claim 20 having molybdenum within the range of 3.00 to 3.50%.

22. The substantially fully ferritic stainless steel welded article of claim 20 having nickel within the range of 1.00 to 2.00%.

23. The substantially fully ferritic stainless steel welded article of claim 22 having molybdenum within the range of 3.00 to 3.50%.

24. A substantially fully ferritic stainless steel welded article with high corrosion resistance, said welded article consisting essentially of, in weight percent, up to 0.04 carbon, up to 0.04 nitrogen, the sum of the carbon plus nitrogen content being above 0.02 but below 0.07, up to 1.0 manganese, up to 1.0 silicon, 23.0 to less than 28.0 chromium, 1.00 to 4.75 nickel, 2.50 to 3.50 molybdenum, 0.12 to 0.70 titanium, with titanium being at least equal to six times the carbon plus nitrogen, and the balance iron and incidental impurities.

25. The substantially fully ferritic stainless steel welded article of claim 24 wherein said welded article has an aswelded Olsen cup height exceeding 0.250 in. at a thickness of 0.060 in.

26. The substantially fully ferritic stainless steel welded article of claim 25 having molybdenum within the range of 3.00 to 3.50%.

27. The substantially fully ferritic stainless steel welded article of claim 25 having nickel within the range of 1.00 to 2.00%.

28. The substantially fully ferritic stainless steel welded article of claim 27 having molybdenum within the range of 3.00 to 3.50%.

29. A substantially fully ferritic stainless steel welded article with high corrosion resistance, said welded article consisting essentially of, in weight percent, up to 0.04 carbon, up to 0.04 nitrogen, with the carbon plus nitrogen content being above 0.02 but below 0.07, up to 1.0 manganese, up to 1.0 silicon, 23.0 to less than 28.0 chromium, 1.00 to 4.75 nickel, 2.50 to 3.50 molybdenum, up to 0.30 titanium, up to 0.30 columbium, with the columbium and titanium contents being at least equal to the amounts given by the following equation:

$$\% Ti/6 + \% Cb/8 = (\%C + \%N)$$

and the balance iron and incidental impurities.

30. The substantially fully ferritic stainless steel welded article of claim 29 wherein said welded article has an aswelded Olsen cup height exceeding 0.250 in. at a thickness of 0.060 in.

31. The fully ferritic stainless steel welded article of claim 30 having molybdenum within the range of 3.00 to 3.50%.

32. The substantially fully ferritic stainless steel welded article of claim 30 having nickel within the range of 1.00 to 2.00%.

33. The substantially fully ferritic stainless steel welded article of claim 32 having molybdenum within the range of 3.00 to 3.50%.

* * * * *

UNITED STATES PATENT OFFICE

CERTIFICATE OF CORRECTION

Patent No. 4,119,765 Dated October 10, 1978

Inventor(s) Kenneth E. Pinnow and Jerome P. Bressanelli

It is certified that error appears in the above-identified patent and that said Letters Patent are hereby corrected as shown below:

TABLE II, under "B. Vacuum-Arc Melted Stainless Steels*", the composition for Material Code Ti-3 should be as follows, beginning with "Mo":

| Mo | Cu | Al | O | N | Ti | Cb |
|---|---|---|---|---|---|---|
| 1.06 | - | - | .0037 | .034 | .15 | - |

TABLE II, under "C. Vacuum-Induction Melted Stainless Steels", under the column headed "Mn", line 6, ".029" should be --0.29--;

TABLE II, under "D. Molybdenum-Titanium Series", under the column headed "Mn", line 6, ".023" should be --0.23--;

TABLE II, under "E. Nickel-Titanium Series", under the column headed "Mn", line 5, ".026" should be --0.26--;

TABLE II, under "F. Nickel-Molybdenum-Titanium Series", under the column headed "Mn", line 4, ".029" should be --0.29--.

Column 9, last line "Alloy 3B78" should be --Alloy 3B82--.

Signed and Sealed this

Sixth Day of March 1979

[SEAL]

Attest:

RUTH C. MASON
Attesting Officer

DONALD W. BANNER
Commissioner of Patents and Trademarks